United States Patent [19]

Tognana

[11] Patent Number: 5,026,322

[45] Date of Patent: Jun. 25, 1991

[54] THRESHING DEVICE

[75] Inventor: Aldo Tognana, Treviso, Italy

[73] Assignee: SEV S.r.l., Treviso, Italy

[21] Appl. No.: 517,274

[22] Filed: May 1, 1990

[30] Foreign Application Priority Data

May 5, 1989 [IT] Italy ..... 82540 A/89

[51] Int. Cl.[5] ..... A01F 7/04; A01F 11/00; A01F 12/22

[52] U.S. Cl. ..... 460/76; 56/27.5; 460/134; 460/143

[58] Field of Search ..... 460/59, 63, 70, 75, 460/76, 74, 99, 134–137, 142, 143, 149; 56/27.5

[56] References Cited

U.S. PATENT DOCUMENTS

| | | | |
|---|---|---|---|
| 3,038,476 | 6/1962 | Anderson | 460/76 |
| 4,270,551 | 6/1981 | Johnston et al. | 460/74 |
| 4,627,446 | 12/1986 | Huhman | 460/74 |
| 4,649,940 | 3/1987 | Mine et al. | 460/142 X |
| 4,805,643 | 2/1989 | Tetaka | 460/123 X |
| 4,836,220 | 6/1989 | Miyake et al. | 460/130 X |

*Primary Examiner*—Stephen J. Novosad

*Attorney, Agent, or Firm*—Guido Modiano; Albert Josif

[57] ABSTRACT

The device has a first threshing rotor bearing a first number of radial blades, and a second counter-rotating loading rotor having a different number of radial blades. The rotors are arranged side by side and adapted to be driven in phase at different speeds. A fan generates a flow of air at a region of alignment of the radial blades of the first and second rotors, and the first rotor has a rear outlet for threshed leaves.

20 Claims, 1 Drawing Sheet

THRESHING DEVICE

BACKGROUND OF THE INVENTION

The present invention relates to a threshing device particularly for tobacco leaves.

In the processing of tobacco it is currently known to use devices which have the function of breaking tobacco leaves, thereby separating the laminar part of the leaves from the ribs or stems; said laminar part assumes the form of particles of lamina termed "strips".

This operation is indispensable since it is the lamina which is subsequently used in the manufacture of tobacco products and must therefore have the greatest and most uniform possible size.

Some known devices use a rotor which is provided with a series of radial blades arranged on diametrical planes, which will be referred to hereafter as dynamic blades.

Such known devices furthermore have a series of fixed blades associated with a static blade holder fixed to the framework.

Advantageously, the fixed blades are arranged on an axis which is diametrical to the rotor so that each series of dynamic blades passes cyclically between two flanking fixed blades.

A grid or a series of grids is provided below said rotor. The rotor usually rotates at a speed of approximately 400–450 rpm and may have six blades on each diametrical plane, whereas the leaves are introduced, by gravity or by pneumatic conveyance, at the region overlying the fixed blades.

The operation of said known devices is aimed at causing the leaves to become arranged transversely between two fixed blades, and then threshed by a dynamic blade in order to mechanically separate the lamina from the rib. The threshing action is completed by rubbing the leaves against a grid, also known as "basket", which is arranged below the rotor.

These known devices, however, are not devoid of disadvantages, not least of which is the fact that perfect placement of the leaves between the fixed blades is very rarely achieved in practice. This results in some leaves not being threshed, while other leaves are subjected, due to the rotation rate of the rotor, to multiple threshings which break up the lamina excessively, thereby reducing the size of the strips obtained.

This is a serious disadvantage because, in order to obtain a high quality product, it is preferable to have the largest and most uniform possible size of strips. In fact, at the threshing region between rotating blades and fixed blades, the condition occurs in which strips already separated from the ribs are undesirably forced to undergo the continuous threshing action of the subsequent rotating blades, because the fixed blades tend to oppose the downward outflow of the strips and ribs, thus causing the very harmful reduction of strip size and loss of uniformity.

Once it has left the threshing region, the product should be completely expelled through the grid.

However, a part does not escape and continues the rotation induced by the rotor.

This product, retained by the grid, undergoes a further threshing action at the rear static blades, if these are adopted, or continues to rotate until it is threshed again at the static blades.

This causes even further undesirable breakage of the strips, which deteriorate and lose uniformity.

In known devices, the use of ducted air flows at the region where the leaves are fed to the rotor has the mere function of conveying the leaves, and said ducted air flow does not prevent the leaves from undergoing numerous threshings.

SUMMARY OF THE INVENTION

The aim of the present invention is therefore to eliminate the disadvantages described above in known types of threshing devices by providing a threshing device which allows to break tobacco leaves, separating the laminar part from the ribs.

Within the scope of the above described aim, one important object of the invention is to provide a device which allows to thresh tobacco leaves so as to obtain a good size of the laminar part or strips to be sent for subsequent processing and the greatest possible length of the rib sections.

A further object of the invention is to provide a device which associates with the preceding characteristics that of being structurally simple as well as being reliable and safe in use.

This aim, these objects and others which will become apparent hereinafter are achieved by a threshing device, particularly for tobacco leaves, characterized in that it comprises at least one first threshing rotor having a plurality of first radial blades, at least one second loading rotor having a plurality of second radial blades, said first rotor and said second rotor being arranged side by side, and adapted to be driven in phase at different speeds, said plurality of first radial blades and said plurality of second radial blades having different numbers of blades and defining therebetween a region of alignment, said device further comprising means for generating a flow of forced air at said region of alignment of said series of first and second blades for placing and pre-orientating leaves on said second blades, said first threshing rotor having at least one rear outlet for said threshed leaves.

BRIEF DESCRIPTION OF THE DRAWINGS

Further characteristics and advantages of the invention will become apparent from the detailed description of a particular but not exclusive embodiment, illustrated only by way of non-limitative example in the accompanying drawing, wherein.

DESCRIPTION OF THE PREFERRED EMBODIMENTS

Figure 1:
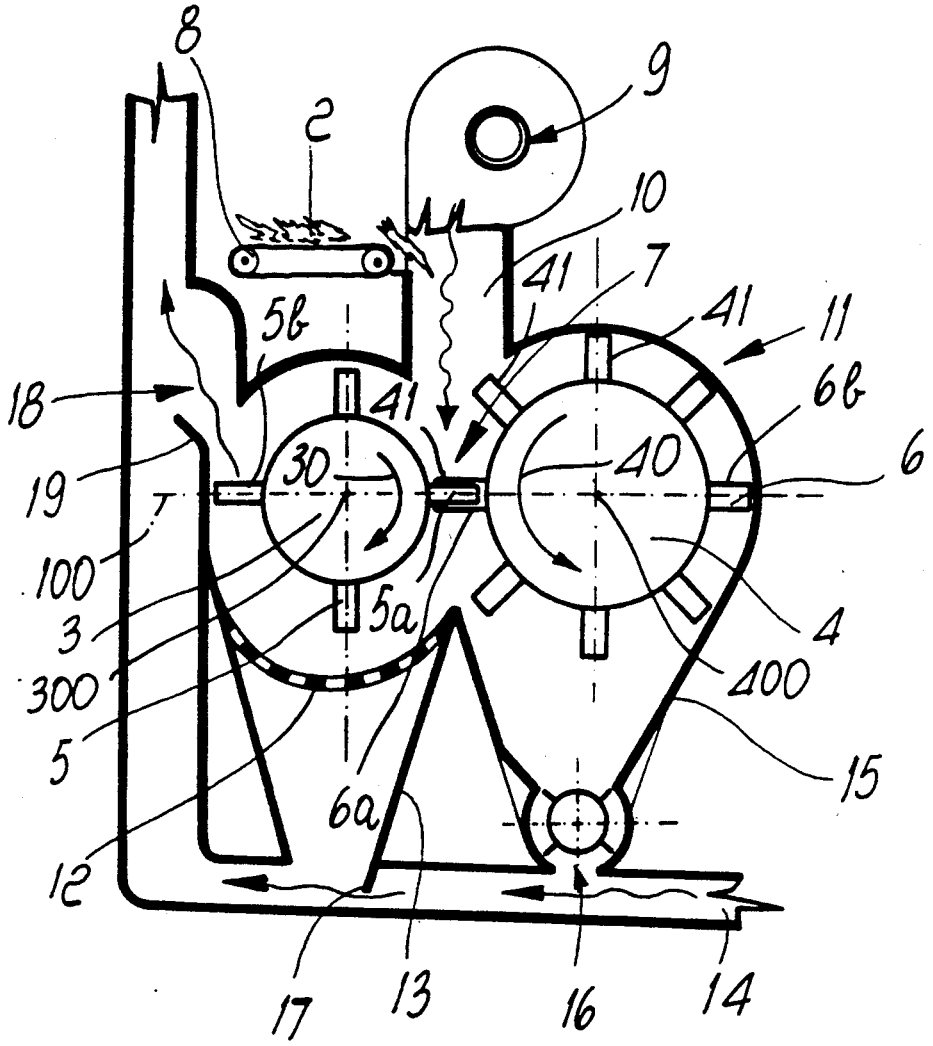
FIG. 1 is a schematic view of the various components of the device.

With reference to the above-cited figure, the device 1 for threshing tobacco leaves 2 for separating the rib and the lamina, is constituted by a first threshing rotor 3 and by a second loading rotor 4 rotatably mounted on the casing or framework 11 of the device. The rotors 3,4 are arranged side by side and driven in phase with respect to one another, as will be described more in detail hereinafter. Any convenient power-assisted means may be used for driving the rotors such as, e.g., an electric motor, and any means may be used for transmitting motion generated by the power-assisted means to the rotors such as, e.g., gear wheels, belts, etc.

The first rotor 3 advantageously but not necessarily has a smaller diameter than that of the second rotor 4 and in any case a rotation speed which is considerably greater than the rotation speed of said second rotor.

Indicatively but not necessarily, the first rotor 3 may rotate at a rate above 400 rpm, whereas the second rotor 4 may rotate at a rate which varies between 40 rpm and 80 rpm.

For the sake of clarity, it will be assumed that the first rotor 3 of FIG. 1 rotates in a clockwise direction indicated by the arrow 30, and that the second rotor 4 rotates in an anticlockwise direction indicated by the arrow 40, though said directions may vary in other embodiments.

The first rotor 3 is provided with a plurality of first radial blades or dynamic blades 5 protrude radially outward from the first rotor 3. As clearly shown in FIG. 1, the plurality of radially protruding blades are arranged on a plurality of diametrical planes. Each diametrical plane has a number of blades 5 provided thereon which may be varied.

The second rotor 4 has a second plurality of blades 6 which protrude radially outwardly from the second rotor 4. Also, as clearly shown in FIG. 1, the second blades 6 are arranged on a plurality of diametrical planes. The longitudinal axis 300 of the first rotor 3 and the longitudinal axis 400 of the second rotor 4 lie in a threshing plane 100, and between the rotors 3, 4 at the threshing plane 100 there is defined a threshing region 7.

As the first rotor 3 rotates, one of the diametrical planes on which some of the first plurality of blades 5*a*, 5*b* are arranged becomes aligned with the threshing plane 100. As the second rotor 4 rotates, one of the diametrical planes on which some of the second plurality of blades 6*a*, 6*b* are arranged becomes aligned with the threshing plane 100. In this condition, each second blade 6*a* lying on the threshing plane 100 at the threshing region 7 occupies an interspace defined between two consecutive first blades 5*a*, which also lie on the threshing plane 100 at the threshing region 7.

A number of eight blades at each diametrical plane is indicated merely by way of example for the second rotor 4.

As mentioned heretofore, the rotors 3, 4 are driven in phase. In other words, the first and second blades 5, 6 sequentially meet on the threshing plane 100 at the threshing region 7 (see the drawing figure).

The diameter of the first and second rotors as well as the respective speeds and the number of blades are in any case such as to allow a single threshing passage of each of said first blades 5 for each pair of second blades 6, which occurs at the threshing plane 100 which passes through the longitudinal axes 300, 400 of both the first and second rotors 3, 4.

Thus, tobacco leaves 2 can be fed into the device 1 at the feed region 7, which lies above the threshing region and in which said first and second blades are aligned, for example by means of a suitable conveyor 8 arranged above said first and second rotors.

The leaves 2, fed into the device, become arranged at the feed region 7, and are forced thereat toward said underlying first and second blades by means of a flow of forced air obtained by means of a fan 9 and an appropriate first duct 10 which lies above the casing or framework 11 of the device.

The fan 9 generates a flow of air which conveys the leaves 2 to the threshing region at a speed which is higher than the peripheral speed of the second rotor 4, so as to force the deposition of the leaves on the backs of the second blades 6. This avoids effects of rejection and ejection of the leaves on the part of the second rotor and achieves a certain pre-orientation of the leaves on the second blade in a transverse direction.

The use of the fan 9 to generate an air flow having a greater velocity than the peripheral speed of the second rotor 4 does not have the function of mere conveyance of the leaves, but, together with the use of the second rotor, that of forcing the leaves between the rear surfaces 41 of blades of said second rotor, thereby achieving a partial pre-orientation of the leaves themselves.

The fact that the first and second rotors are set in phase, for example by means of an appropriate transmission with a reduction ratio, ensures that the leaves undergo just one single threshing operation, thereby causing the resulting lamina and rib to be expelled due to the rotation action of the second rotor and the overlying flow of air. In this manner, useless and harmful further threshing of the leaves is avoided.

The device may have, below the first rotor 3, a grid or "basket" 12, and a first hopper 13 connected to a second duct 14 which extends laterally to said first rotor.

Similarly, a second hopper 15 provided with a valve 16 for interconnection with the second duct 14 is provided below the second rotor 4.

The first hopper 13 furthermore has a first tab 17 which protrudes within the second duct 14 to create a Venturi effect.

A rear outlet 18 is provided behind the first rotor 3 on the framework 11 on the opposite side with respect to the first duct 10 and may also be under negative pressure by virtue of the presence of a second tab 19 which protrudes into the second duct 14 or may exploit the kinetic energy induced in the product by the rotation of the threshing rotor.

Said outlet 18 allows to extract the strips which, having failed to pass through the basket 12, would tend to keep rotating, undergoing further useless and harmful threshings at the first and second blades or at other static blades possibly provided.

It has thus been observed that the invention has achieved the intended aim and objects, since the use of the two separate rotors with different speeds and with a different number of blades allows to subject each individual leaf to a single threshing operation which leads to the obtainment of a lamina of considerable size.

The device furthermore allows to remove, at the outlet 18 of the first rotor 3, the lamina already separated from the rib (also termed "free lamina") without said lamina being subjected to further threshings if it is kept rotating due to failure to pass through the basket 12.

This, also contributes to the obtainment of laminae with the largest and most uniform possible size for subsequent manufacturing steps.

The device is furthermore structurally very simple and requires only minimal maintenance, since there are no fixed blades on which laminae may accumulate during threshing. Furthermore, the device is less subject to damage than known devices in the event of accidental introduction of foreign matter.

The invention is susceptible to numerous modifications and variations, all of which are within the purview of the same inventive concept. For example, any number of blades may constitute the first and second pluralities of blades, and any suitable arrangement of the blades at the peripheral surface of the rotors may be adopted, such as, e.g., a possible arrangement in a spiral or helical configuration may be employed, providing that said blades be arranged periodically mutually in phase at the threshing region defined between the first and second rotors.

The device may furthermore comprise a plurality of said first and second rotors arranged mutually in sequence, in order to achieve successive further threshings if desired.

The device may also employ a single threshing rotor with a rear outlet.

The materials and the dimensions of the individual components of the device may naturally be the most appropriate according to specific requirements.

I claim:

1. Threshing device, particularly for tobacco leaves, comprising:

at least one first threshing rotor having a first rotor axis, a plurality of first blades rigidly connected to and protruding radially from said first threshing rotor, at least one second rotor having a second rotor axis, a plurality of second blades rigidly connected to and protruding radially from said second rotor, a threshing zone defined between said first rotor and said second rotor, wherein said first rotor axis and said second rotor axis lie side by side on a threshing plane, said first rotor and said second rotor being driven at different speeds, said plurality of first blades and said plurality of second blades comprising different numbers of blades, and wherein said first blades and said second blades sequentially meet on said threshing plane at said threshing region, said device further comprising:

means for generating a flow of forced air at said threshing region, whereby to place and pre-orientate leaves on said second blades at said threshing plane, and at least one rear outlet provided rearwardly of said first rotor, said outlet defining an outlet for threshed leaves.

2. Device according to claim 1, wherein said means for generating a flow of forced air at said threshing region comprise at least one fan and at least one first duct, and wherein said flow of forced air generated by said fan is directed into said threshing zone via said first duct, said second rotor being operable to define a peripheral speed, said flow of forced air defining an air-flow speed, said air-flow speed being greater than said peripheral speed of said second rotor.

3. Device according to claim 2, wherein said second blades define rear surfaces, and wherein said means for generating said flow of forced air produce a flow of forced air defining a pre-orientating direction, whereby said flow of forced air causes pre-orientation of leaves fed into said device with respect to said rear surfaces of said second blades.

4. Device according to claim 1, further comprising a framework, and wherein said at least one rear outlet is located on said framework behind said first rotor, whereby to permit extraction of strips obtained by a single threshing of a leaf.

5. Device according to claim 4, wherein said means for generating a flow of forced air at said threshing region comprise at least one fan and at least one first duct, wherein said flow of forced air generated by said fan is directed into said threshing zone via said first duct, said second rotor being operable to define a peripheral speed, said flow of forced air defining an air-flow speed, said air-flow speed being greater than said peripheral speed of said second rotor, and wherein said framework has at least one side and at least one opposite side, said first duct being located at said one side of said framework, said rear outlet being located at said opposite side of said framework.

6. Device according to claim 1, further comprising means for generating negative pressure at said outlet.

7. Device according to claim 6, further comprising at least one second duct, wherein said outlet communicates with said second duct, and wherein said means for generating negative pressure at said outlet comprise at least one second tab, said second tab protruding into said second duct, whereby to create a Venturi effect therein.

8. Device according to claim 6, further comprising at least one second duct, at least one second hopper, and at least one valve, wherein said outlet communicates with said second duct, and wherein said means for generating negative pressure at said outlet comprise at least one second tab, said second tab protruding into said second duct, whereby to create a Venturi effect therein, said second hopper being located below said second rotor, said valve interconnecting said second hopper and said second duct.

9. Device according to claim 1, wherein said first rotor defines a first rotor peripheral speed, and wherein said second rotor defines a second rotor peripheral speed, said first rotor peripheral speed being greater than said second rotor peripheral speed.

10. Device according to claim 9, wherein, during rotation of said first rotor and said second rotor, said first plurality of blades defines consecutive first blades lying on said threshing plane, said consecutive first blades defining therebetween interspaces, and wherein each of said second blades located at said threshing plane occupies one of said interspaces defined between said consecutive first blades, whereby to obtain a single threshing for said leaves at said threshing region.

11. Threshing device, particularly for tobacco leaves, comprising:

at least one first threshing rotor having a first rotor axis, a plurality of first blades rigidly connected to and protruding radially from said first threshing rotor, at least one second rotor having a second rotor axis, a plurality of second blades rigidly connected to and protruding radially from said second rotor, a threshing zone defined between said first rotor and said second rotor, wherein said first rotor axis and said second rotor axis lie side by side on a threshing plane, said first rotor and said second rotor being driven at different speeds, said plurality of first blades and said plurality of second blades comprising different numbers of blades, and wherein said first blades and second blades sequentially meet on said threshing plane at said threshing region, said device further comprising:

means for generating a flow of forced air at said threshing region, whereby to place and pre-orientate leaves on said second blades at said threshing plane, and at least one rear outlet provided rearwardly of said first rotor, said outlet defining an outlet for threshed leaves, wherein during rotation of said first rotor and said second rotor, said first plurality of blades defines consecutive first blades lying on said threshing plane, said consecutive first blades defining therebetween interspaces, and, wherein each of said second blades located at said threshing plane occupies one of said interspaces defined between said consecutive first blades, whereby to obtain a single threshing for said leaves at said threshing region.

12. Device according to claim 11, wherein said means for generating a flow of forced air at said threshing region comprise at least one fan and at least one first duct, and wherein said flow of forced air generated by said fan is directed into said threshing zone via said first duct, said second rotor being operable to define a peripheral speed, said flow of forced air defining an air-flow speed, said air-flow speed being greater than said peripheral speed of said second rotor.

13. Device according to claim 11, wherein said first rotor defines a first rotor peripheral speed, and wherein said second rotor defines a second rotor peripheral speed, said first rotor peripheral speed being greater than said second rotor peripheral speed.

14. Device according to claim 13, wherein said first rotor peripheral speed is above 400 rpm.

15. Device according to claim 13, wherein said second rotor peripheral speed is from 40 rpm to 80 rpm.

16. Threshing device, particularly for tobacco leaves, comprising:

at least one first threshing rotor having a first rotor axis, a plurality of first blades rigidly connected to and protruding radially from said first threshing rotor, at least one second rotor having a second rotor axis, a plurality of second blades rigidly connected to and protruding radially from said second rotor, a threshing zone defined between said first rotor and said second rotor, wherein said first rotor axis and said second rotor axis lie side by side on a threshing plane, said first rotor and said second rotor being driven at different speeds, said plurality of first blades and said plurality of second blades comprising different numbers of blades, wherein said first blades and said second blades sequentially meet on said threshing plane at said threshing region, wherein, during rotation of said first rotor and said second rotor, said first plurality of blades defines consecutive first blades lying on said threshing plane, said consecutive first blades defining therebetween interspaces, and, wherein each of said second blades located at said threshing plane occupies one of said interspaces defined between said consecutive first blades, whereby to obtain a single threshing for said leaves at said threshing region.

17. Device according to claim 16 further comprising:

means for generating a flow of forced air at said threshing region, whereby to place and pre-orientate leaves on said second blades at said threshing plane, and at least one rear outlet provided rearwardly of said first rotor, said outlet defining an outlet for threshed leaves.

18. Device according to claim 16 further comprising;

means for generating a flow of forced air at said threshing region, whereby to place and pre-orientate leaves on said second blades at said threshing plane, and at least one rear outlet provided rearwardly of said first rotor, said outlet defining an outlet for threshed leaves, wherein said mans for generating a flow of forced air at said threshing region comprise at least one fan and at least one first duct, wherein said flow of forced air generated by said fan is directed into said threshing zone via said first duct, said second rotor being operable to define a peripheral speed, said flow of forced air defining an air-flow speed, said air-flow speed being greater than said peripheral speed of said second rotor, and wherein said first rotor defines a first rotor peripheral speed, and wherein said second rotor defines a second rotor peripheral speed, said first rotor peripheral speed being greater than said second rotor peripheral speed.

19. Device according to claim 18, wherein said first rotor peripheral speed is above 400 rpm.

20. Device according to claim 18, wherein said second rotor peripheral speed is from 40 rpm to 80 rpm.

* * * * *